United States Patent [19]

Glendening

[11] Patent Number: 5,029,506

[45] Date of Patent: Jul. 9, 1991

[54] PAPER PERFORATING ASSEMBLY

[75] Inventor: Major D. Glendening, St. Joseph, Mich.

[73] Assignee: F. P. Rosback Company, St. Joseph, Mich.

[21] Appl. No.: 451,888

[22] Filed: Dec. 18, 1989

[51] Int. Cl.[5] ..... B26F 1/24

[52] U.S. Cl. ..... 83/660; 83/678; 83/867

[58] Field of Search ..... 83/660, 669, 866, 867, 83/868, 676, 677, 506, 332, 678

[56] References Cited

U.S. PATENT DOCUMENTS

| | | | |
|---|---|---|---|
| 3,152,501 | 10/1964 | Nassar | 83/676 |
| 3,677,122 | 7/1972 | Rautine | 83/506 |
| 3,760,671 | 9/1973 | Jenkins | 83/155 |
| 3,777,610 | 12/1973 | Spaller, Jr. | 83/678 |
| 3,908,499 | 9/1975 | Reed | 83/665 |
| 3,988,976 | 2/1976 | Slezak | 83/867 |
| 4,667,552 | 5/1987 | Calligarich | 83/171 |

FOREIGN PATENT DOCUMENTS

| | | | |
|---|---|---|---|
| 3439199 | 2/1986 | Fed. Rep. of Germany | 83/866 |

*Primary Examiner*—Frank T. Yost
*Assistant Examiner*—John M. Husar
*Attorney, Agent, or Firm*—Thomas J. Dodd

[57] ABSTRACT

A paper perforating assembly which is designed for use in micro-perforating. The assembly includes a micro-perf cutter blade which is attached to a rotatable shaft of a perforating machine. The assembly also includes a cutting ring assembly attached to a second rotatable shaft of the machine. The cutting ring is preferably backed by a soft biasing member carried in a channel of the ring assembly and allows the ring to float which compensates for concentricity problems during perforating.

3 Claims, 3 Drawing Sheets

PAPER PERFORATING ASSEMBLY

SUMMARY OF THE INVENTION

This invention relates to paper perforating and will have application to a means of doing crush-cut type perforating on a fixed shaft, sheet fed, perforating machine.

Crush-cut type perforating consists of a rotating cutter, ground to a knife edge, with axial teeth. The cutter rotates against a hardened lower shaft or surface. When the teeth of the rotating cutter range from about 54 to 72 teeth per inch the method best known in the field as micro-perf perforations. Therefore from this point on we will refer to the method as micro-perf.

In micro-perf the paper is fed between a rotating cutter and a glass hard shaft, a large number of small perforations are formed along a desired tearing line to allow a section of the paper to be easily torn away. The process is used to perforate the side edges of track feed computer sheet, among other products, giving an appearance of a cut edge when torn apart.

Up until now this type of performation has only been successful on web presses where individual cutters are mounted separately and independently adjusted against a hardened rotating shaft. The independent cutters are held against the hardened, rotating shaft by pressure applied by either spring tension or pneumatic means. The pressure from these sources are adjustable for different paper thickness as well as for texture.

In a fixed shaft, sheet fed perforator it has not been possible to mount individual cutters, nor to apply pressure on an individual basis.

The perforating assembly of this invention does provide a means of mounting multiple cutters on a single rotating shaft and still provide a means of adjusting the pressure on the individual cutters. A micro-perf cutter wheel is mounted in a holding device which is firmly held on to a rotating shaft. A floating glass hard ring is held in a ring housing which is mounted on an adjacent rotating shaft. Pressure in this case is applied by the compression of one or more biasing members on which the glass hard rings are mounted.

Accordingly, it is an object of this invention to provide for an improved paper performing assembly.

Another object is to provide a self-aligning perforator which maintains cutter-cutting surface concentricity.

Another object is to provide a perforating assembly for micro-perfing variable thickness paper stock in a fixed shaft machine.

Other objects will become apparent upon a reading of the following description.

DESCRIPTION OF THE PREFERRED EMBODIMENT

Figure 1:
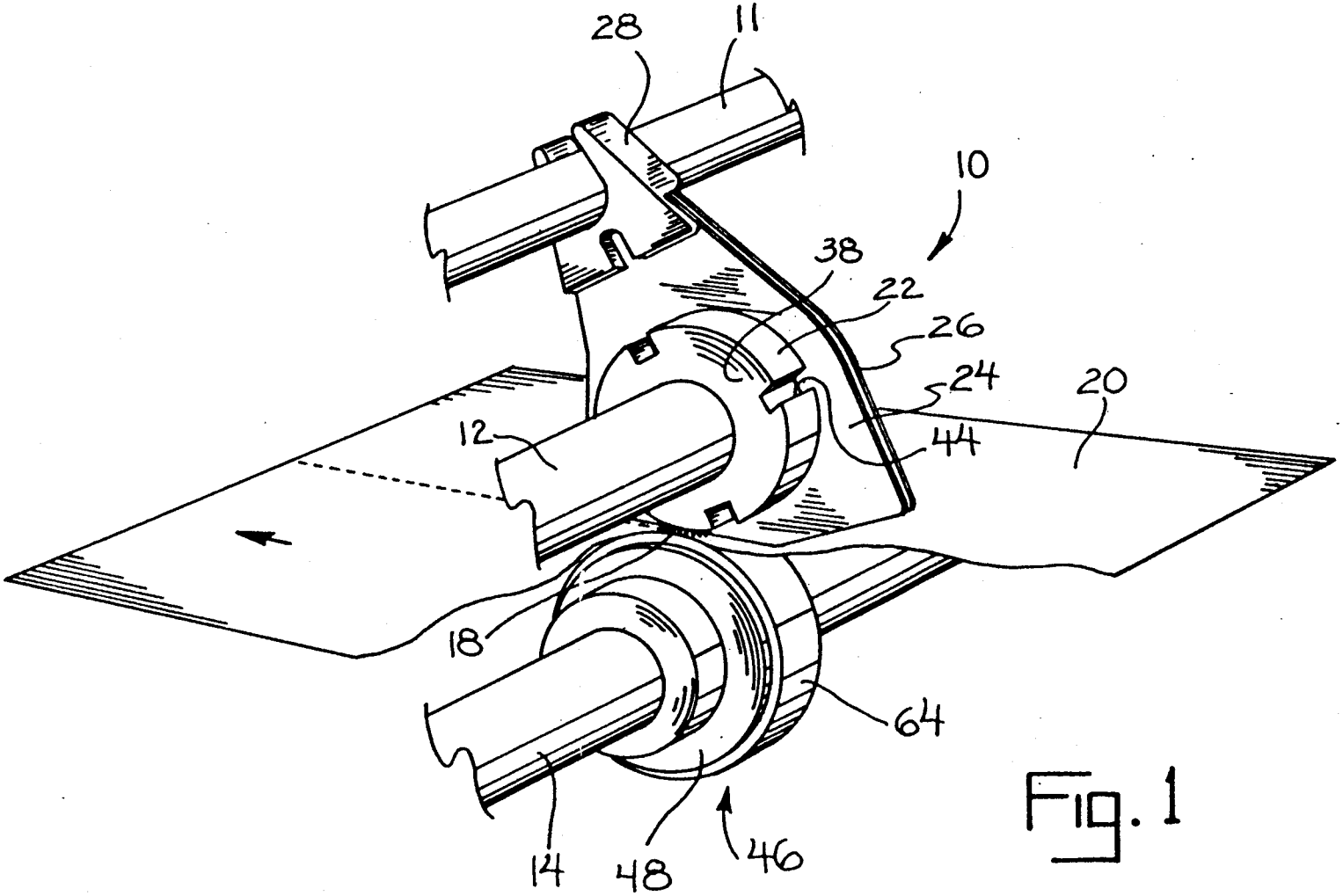
FIG. 1 is a fragmented perspective view of the perforating assembly of the invention in use.

The preferred embodiment herein described is not intended to be exhaustive or to limit the invention to the precise form disclosed. It is chosen and described to explain the principles of the invention and its application and practical use to enable others skilled in the art to practice its teachings.

Referring to the drawings, reference numeral 10 generally designates the perforating assembly of this invention. Assembly 10 may be used with most types of conventional paper cutting and perforating machines (not shown) which include shaft 11, 12, and 14 to which the assembly parts may be attached. A typical paper cutting and perforating machine of this sort is shown in the brochure of F. P. Rosback Company enclosed with this application.

Figure 2:
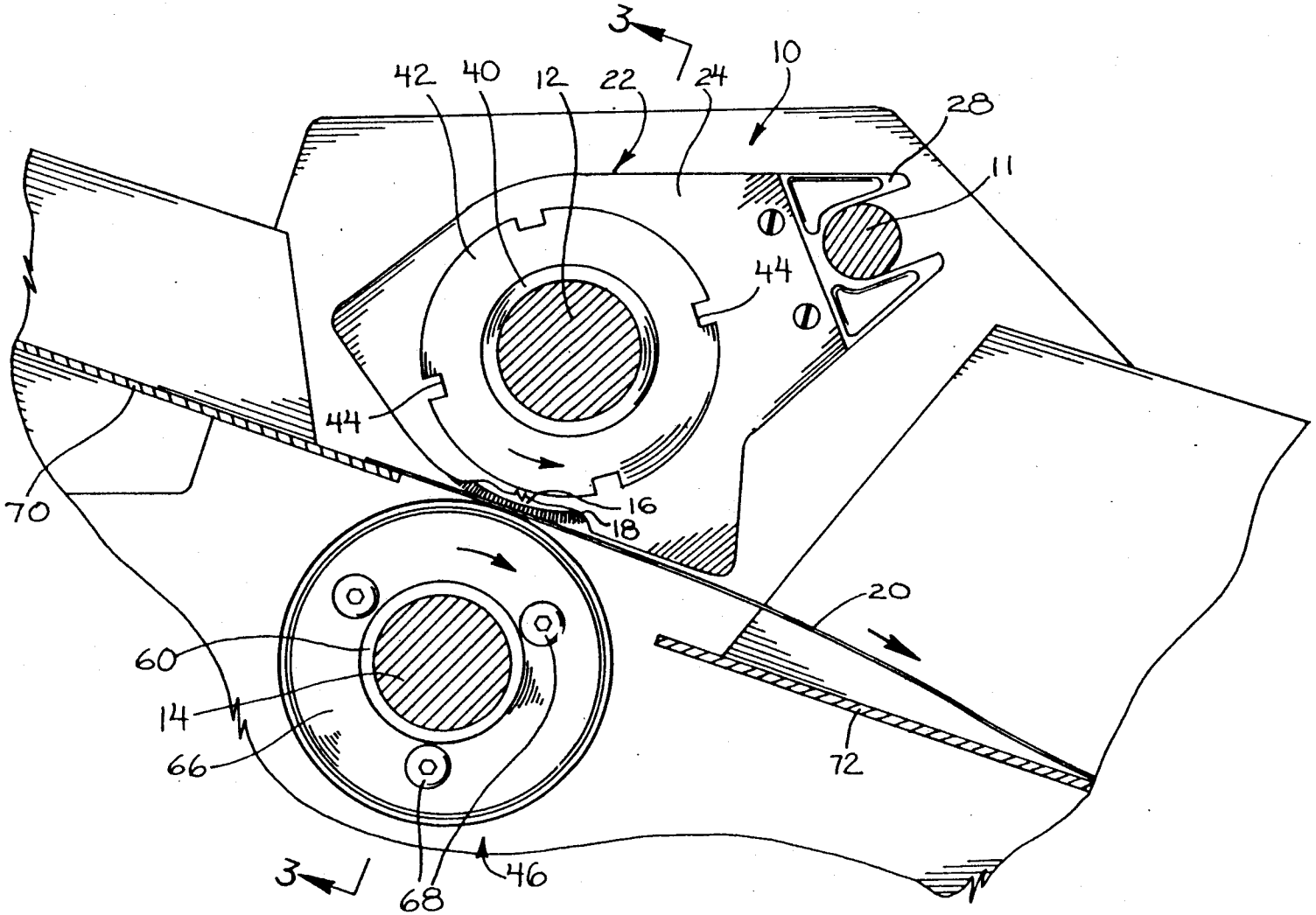
FIG. 2 is a sectional view of the assembly of FIG. 1.

As shown in FIGS. 1 and 2, assembly 10 includes a cutter disc 16 which has a plurality of cutting teeth 18. Disc 16 is preferably of the type referred to as a micro-perf disc and generally includes between fifty and seventy-two teeth 18 per inch of cutting surface. Mircoperf is currently and has been a recognized method of perforating paper stock 20 without completely piercing the paper.

Figure 4:
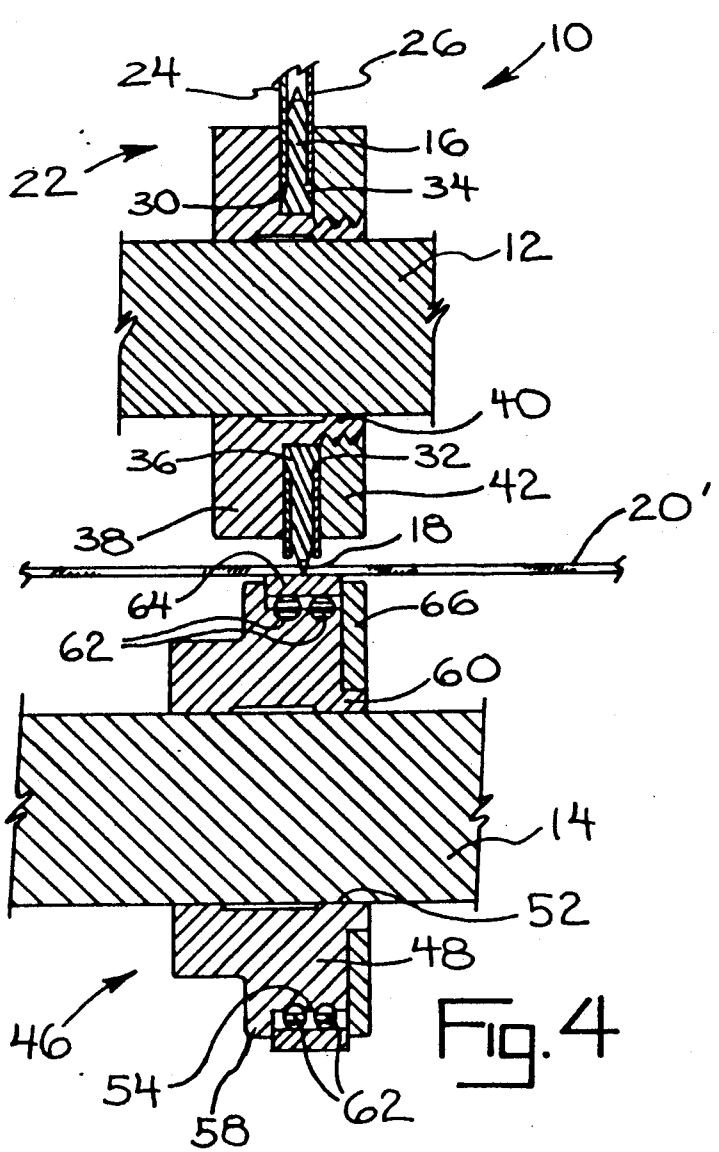
FIG. 4 is a sectional view similar to FIG. 3 with the assembly in use on thicker paper stock.
Figure 3:
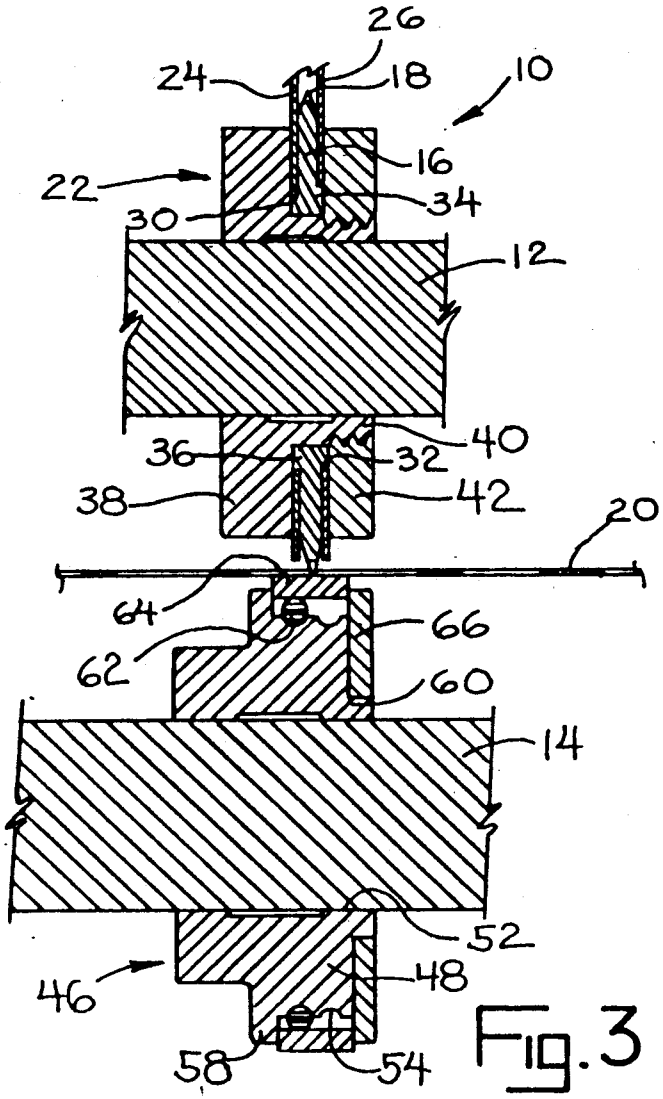
FIG. 3 is a sectional view taken along line 3—3 of FIG. 2.

Disc 16 is connected to a housing 22 as shown in FIGS. 3 and 4. Housing 22 includes a pair of thin cover plates 24, 26 which are connected to coupler 28. Disc 16 is located in aligned holes 30, 32 of cover plates 24, 26 by opposite side located disc shoulders 34, 36. Housing 22 also includes ring 38 which has a threaded boss 40 extending through holes 30, 32. A coupling ring 42 is threaded about boss 40 to firmly secure the cover plates against wobble during perforating operations. Each ring 38, 42 has spaced notches 44 to allow for disassembly of housing 22 by a suitable tool (not shown). Set screw (not shown) extends through ring 38 to firmly secure housing 22 to shaft 12.

Assembly 10 to also includes cutting surface assembly 46. Assembly 46 includes shaft coupling 48 which is secured to shaft 14 through set screw (not shown) which extends through the coupling. Coupling 48 is generally circular and defines a central bore 52 in which shaft 14 is accommodated. Coupling 48 has one or more annular peripheral grooves 54 defined therein (two are shown). Coupling 48 has a peripheral ring flange 58 adjacent grooves 54 and a central boss 60 as shown.

One or more biasing members such as rubber O-rings 62 are accommodated in grooves 54. A hard ring 64, preferably of steel, overlies and abuts tightly aganist O-rings 62 and against enlarged ring portion 58. Each cap 66 locates about boss 60 and abuts against ring 64 as shown. Fasteners as threaded through end cap 66 coupling 48 secure ring 64 to form assembly 46.

Assembly 10 is used to form micro-perforations in paper stock 20 as follows. With the appropriate disc 16 secured to housing 22 as above described and with housing 22 and assembly 46 secured to shafts 12, 14 respectively, paper stock 20 is fed in a conventional manner along table 70 between disc teeth 18 and ring 64 as shown best in FIGS. 3–4. As the paper stock 20 passed between teeth 18 and ring 64, the teeth cut minute indentations (micro-perf) in the paper which renders it easy to tear in a straight line. O-ring 62 biases the position of ring 64 relative to disc 16 to ensure that constant pressure is applied which is necessary for a continuous micro-perf cut. As shown in FIG. 4, two O-rings 62 may be used when heavier weight paper 20' is to be perforated. After the paper 20 passes between teeth 18 and ring 64 it travels across table 72 and onto a conventional sheet delivery (not shown). Shafts 12, 14 rotate along with common paper feed rolls (not shown) during perforating to ensure a proper cut.

It is understood that the invention is not limited to the details above-given, but may be modified within the scope of the following claims.

I claim:

1. In an assembly for perforating paper stock, said assembly including a cutting disk having teeth contacting a hard cutting surface, the improvement wherein said cutting surface includes a ring connected to a ring housing, biasing means carried by said ring housing and underlying said ring for maintaining constant pressure of said cutting disk teeth against said ring during feeding of paper stock therebetween, said disk rotatably secured to a cutting housing secured to a first rotating shaft, said ring housing including an annular housing member having a protruding flange, a groove in said housing member, said biasing means including a generally circular biasing member fitted in said groove, said circular member capable of being compressed when said ring is contacted by said disk.

2. The assembly of claim 1 wherein said cutting housing includes a first housing ring having a protruding boss, said disc sandwiched between two cover plates located about said boss, and a second housing ring fastened to said boss and constituting clamp means for securing said disc and cover plate to said housing.

3. The assembly of claim 1 and a cap connected to said housing member, said cap constituting clamp means for securing said ring between the cap and said flange.

* * * * *